US007475444B2

(12) United States Patent
Yim et al.

(10) Patent No.: US 7,475,444 B2
(45) Date of Patent: Jan. 13, 2009

(54) WASHING MACHINE AND METHOD OF CONTROLLING THE SAME

(75) Inventors: Il Hyeok Yim, Kyungki-do (KR); Ho Cheol Kwon, Kyungsangnam-do (KR); Hack Chai Song, Kyungsangnam-do (KR); Beon Jun Kim, Kyungsangnam-do (KR)

(73) Assignee: LG Electronics Inc., Seoul (KR)

( * ) Notice: Subject to any disclaimer, the term of this patent is extended or adjusted under 35 U.S.C. 154(b) by 555 days.

(21) Appl. No.: 11/183,809

(22) Filed: Jul. 19, 2005

(65) Prior Publication Data

US 2006/0010614 A1 Jan. 19, 2006

(30) Foreign Application Priority Data

Jul. 20, 2004 (KR) ..... 10-2004-0056266
Jul. 20, 2004 (KR) ..... 10-2004-0056267
Jul. 20, 2004 (KR) ..... 10-2004-0056268

(51) Int. Cl.
*D06F 35/00* (2006.01)
*D06F 33/00* (2006.01)

(52) U.S. Cl. ..... 8/158; 8/159; 68/12.04; 68/12.06

(58) Field of Classification Search ..... 68/12.04, 68/12.06
See application file for complete search history.

(56) References Cited

U.S. PATENT DOCUMENTS 5,325,677 A * 7/1994 Payne et al. ..... 68/12.04
6,401,284 B1 * 6/2002 Jeon et al. ..... 8/158
6,460,381 B1 * 10/2002 Yoshida et al. ..... 68/12.04
2003/0028261 A1 * 2/2003 Peterson et al. ..... 700/19
2003/0140427 A1 * 7/2003 Yamamoto et al. ..... 8/159

FOREIGN PATENT DOCUMENTS

DE 37 41 792 A1 6/1989

* cited by examiner

*Primary Examiner*—Michael Barr
*Assistant Examiner*—Rita R Patel
(74) *Attorney, Agent, or Firm*—Birch, Stewrt, Kolasch & Birch, LLP

(57) ABSTRACT

A washing machine and a method of controlling the same that is capable of determining whether laundry is a single load or a multiple load based on detected value of eccentricity or detected laundry amount and changing revolutions per minute of a motor or the number of eccentricity detections based on the determined load amount such that different spin-drying actions are performed. The washing machine comprises an eccentricity detecting unit for detecting eccentricity of laundry received in a drum, a motor driving unit for driving a motor such that the drum is rotated, and a microprocessor for determining whether the laundry is a single load or a multiple load based on the value of eccentricity detected by the eccentricity detecting unit and changing revolutions per minute of the motor or the number of eccentricity detections of the eccentricity detecting unit based on the initially determined load amount.

16 Claims, 7 Drawing Sheets

WASHING MACHINE AND METHOD OF CONTROLLING THE SAME

BACKGROUND OF THE INVENTION

1. Field of the Invention

The present invention relates to a washing machine and a method of controlling the same, and, more particularly, to a washing machine and a method of controlling the same that is capable of determining whether laundry is a single load or a multiple load based on detected value of eccentricity or detected laundry amount and changing revolutions per minute of a motor or the number of eccentricity detections based on the determined load amount such that different spin-drying actions are performed, thereby preventing incorrect determination as to whether the laundry is a single load or a multiple load and malfunction of the washing machine and reducing time required until a spin-drying entry is initiated.

2. Description of the Related Art

Generally, a washing machine is a machine that washes laundry to removes contaminants from the laundry. According to a selected washing operation, wash water is supplied into the washing machine such that the laundry is sufficiently submerged in the wash water, an appropriate amount of detergent is dissolved in the wash water such that the contaminants are removed from the laundry by a chemical action between the contaminants and the dissolved detergent, and a drum, in which the laundry is received, is rotated such that the contaminants are removed from the laundry by mechanical friction between the laundry and the wash water.

FIG. 1 is a perspective view showing the structure of a conventional washing machine 1. As shown in FIG. 1, the conventional washing machine 1 comprises: a drum (not shown) for receiving laundry; a motor (not shown) for rotating the drum; an input unit (not shown) for inputting information to set the operation of the washing machine 1; a display unit (not shown) for displaying the operation of the washing machine 1; and a microprocessor (not shown) for controlling the washing operation of the washing machine 1 and all the other operations of the washing machine 1.

The conventional washing machine 1 further comprises: a water supply valve and a water drain valve, which are turned on and off. The washing machine 1 performs the washing operation of washing the laundry received in the drum under the control of the microprocessor.

After the washing machine 1 removes contaminants from the laundry, the motor is driven at high speed such that moisture is removed from the laundry by centrifugal force generated in the drum. In this way, the spin-drying action is performed by the washing machine 1, by which the laundry can be easily dried.

Now, a method of controlling the conventional washing machine with the above-stated construction will be described with reference to FIGS. 2 and 3. FIG. 2 is a flow chart illustrating a load determining process of the conventional washing machine, and FIG. 3 is a flow chart illustrating a spin-drying entry process of the conventional washing machine in the case of a single load.

According to a washing course set by a user, the washing machine 1 performs a washing/rinsing/spin-drying operation, and therefore, a water supplying action and a water draining action are repeatedly carried out (S1).

While each of the above-described operations is performed, a spin-drying action is performed several times. Before the spin-drying action is performed, an eccentricity detecting process is performed to determine the degree of eccentricity of laundry received in the drum. The eccentricity detecting process is repeatedly performed a predetermined number of times or more (S2).

At this time, detected value of eccentricity is counted whenever the detected value of eccentricity is equal to or greater than a predetermined reference value of eccentricity. When the counted number of the detected value of eccentricity equal to or greater than the predetermined reference value of eccentricity is a predetermined value or more, the washing machine 1 determines that the laundry is a single load. When the detected value of eccentricity is equal to or greater than the predetermined reference value of eccentricity, or the counted number of the detected value of eccentricity equal to or greater than the predetermined reference value of eccentricity is a predetermined value or more, on the other hand, the washing machine 1 determines that the laundry is a multiple load (S4, S6).

Especially when the counted number of the detected value of eccentricity equal to or greater than the predetermined reference value of eccentricity is 19 or more after the eccentricity detecting process is performed 20 times or more, the washing machine 1 determines that the laundry is a single load.

Based on the determination as to whether the laundry is a single load or a multiple load, which is performed by the eccentricity detecting process, revolutions per minute of the drum is changed, and then the spin-drying action is carried out (S5, S7).

The spin-drying entry process of the conventional washing machine in the case of a single load is performed as follows.

As illustrated in FIG. 3, it is determined whether the load received in the drum of the washing machine is a single load or a multiple load through the above-described procedure after water is drained (S11, S12).

When it is determined that the laundry is a single load, a value of eccentricity of the laundry is detected before the spin-drying action is carried out.

At this time, the detected value of the eccentricity is compared with the predetermined reference value of eccentricity to determine whether the detected value of the eccentricity is equal to or less than the predetermined reference value of eccentricity (S13).

When the detected value of the eccentricity is greater than the predetermined reference value of eccentricity, the eccentricity of the laundry is detected several times until the detected value of the eccentricity is equal to or less than the predetermined reference value of eccentricity. When the detected value of the eccentricity is equal to or less than the predetermined reference value of eccentricity, on the other hand, the spin-drying action is carried out (S14).

If the detected value of the eccentricity is greater than the predetermined reference value of eccentricity for a single load, the washing machine 1 repeatedly performs the eccentricity detecting process. When the above-described spin-drying entry attempt is performed 35 times or more, the rinsing action is carried out again.

If the spin-drying entry attempt, at which the eccentricity detecting process is repeatedly performed until the detected value of the eccentricity is equal to or less than the predetermined reference value of eccentricity, is performed 70 times or more, it is determined that the washing machine has malfunctioned, and therefore, the operation of the washing machine is stopped.

In the load determination process of the conventional washing machine 1, however, the spin-drying action is carried out based on the initial determination as to whether the laundry is a single load, and the determination as to whether the laundry is a single load or a multiple load is repeatedly carried out when the spin-drying entry is initiated while the washing/rinsing operation is performed. As a result, it takes too much time until the spin-drying entry is initiated. Consequently, washing time is increased, and therefore, energy efficiency is reduced.

Large-sized towels or winter clothes are laundry the amount of which is large. In the load determination process of the conventional washing machine 1, however, such laundry, the amount of which is large, is determined to be a single load, and therefore, the spin-drying action is carried out based on the single load.

As described above, a large amount of laundry is determined to be a single load, and therefore, the spin-drying action is carried out based on the single load although the value of eccentricity is large. As a result, excessive vibration or noise is generated from the washing machine. Furthermore, the washing machine may overheat.

In addition, the spin-drying entry process of the washing machine 1 has the following problems. When the washing machine 1 is operated while one or two pieces of laundry are received in the drum, the laundry is determined to be a single load, and therefore, the value of eccentricity of the laundry in the drum is greatly increased. As a result, the eccentricity detecting process is repeatedly performed for several minutes until the value of eccentricity is equal to or less than the predetermined reference value of eccentricity. Consequently, time required until the spin-drying action is carried out is increased. Furthermore, when the operation of the washing machine 1 is stopped due to several spin-drying entry attempts, it may be incorrectly determined that the washing machine 1 malfunctions.

SUMMARY OF THE INVENTION

Therefore, the present invention has been made in view of the above problems, and it is an object of the present invention to provide a washing machine and a method of controlling the same that is capable of detecting eccentricity of laundry received in a drum and rotating the drum for a predetermined period of time based on the detected value of eccentricity of the laundry to carry out a temporary spin-drying action, thereby reducing the value of eccentricity of the laundry in the case of a single load, and therefore, reducing time required until a spin-drying entry is initiated.

It is another object of the present invention to provide a washing machine and a method of controlling the same that is capable of performing an eccentricity detecting process based on the result of the initial determination when detecting the eccentricity of the laundry in the drum, and therefore, determining whether the laundry is a single load or a multiple load, and carrying out a spin-drying action based on the result of the determination as to whether the laundry is a single load or a multiple load, thereby reducing time required until a spin-drying entry is initiated.

It is yet another object of the present invention to provide a washing machine and a method of controlling the same that is capable of detecting the laundry amount, before determining whether the laundry received in the drum is a single load or a multiple load, to determine whether the laundry is a single load or a multiple load based on the detected laundry amount, thereby preventing incorrect determination as to whether the laundry is a single load or a multiple load and malfunction of the washing machine and reducing vibration or noise generated from the washing machine.

In accordance with one aspect of the present invention, the above and other objects can be accomplished by the provision of a washing machine comprising: an eccentricity detecting unit for detecting the degree of eccentricity of laundry received in a drum; a motor driving unit for driving a motor such that the drum is rotated by the motor; and a microprocessor for determining whether the laundry is a single load or a multiple load based on the value of eccentricity detected by the eccentricity detecting unit and changing revolutions per minute of the motor or the number of eccentricity detections of the eccentricity detecting unit based on the initially determined load amount.

Preferably, the microprocessor comprises: an eccentricity determining unit for comparing the value of eccentricity detected by the eccentricity detecting unit with a predetermined reference value of eccentricity for the single load; a load determining unit for determining whether the laundry is a single load or a multiple load based on the result of determination performed by the eccentricity determining unit; and a control unit for controlling the number of eccentricity detections of the eccentricity detecting unit and revolutions per minute of the motor based on the determined load.

Preferably, when the laundry is the single load, the eccentricity determining unit determines whether the value of eccentricity detected by the eccentricity detecting unit is a value of eccentricity within a resonance band based on eccentricity data stored in a data storage unit.

Preferably, when the value of eccentricity detected by the eccentricity detecting unit is the value of eccentricity within the resonance band, the control unit controls the motor to be rotated at predetermined revolutions per minute such that a temporary spin-drying action is carried out to reduce the degree of eccentricity of the laundry in the drum.

In accordance with another aspect of the present invention, there is provided a washing machine comprising: a laundry amount detecting unit for detecting the amount of laundry received in the drum; an eccentricity detecting unit for detecting the degree of eccentricity of laundry received in the drum; and a microprocessor for determining whether the laundry is a single load, if it is determined that the laundry amount is small as a result of the determination as to the laundry amount detected by the laundry amount detecting unit, to differently set the rotation of the drum.

Preferably, the microprocessor comprises: a control unit for determining that the laundry is a multiple load without performing additional determination as to whether the laundry is a single load or a multiple load if it is determined that the laundry amount is large, and determining the load amount based on the detected value of eccentricity if it is determined that the laundry amount is small.

In accordance with another aspect of the present invention, there is provided a method of controlling a washing machine, comprising: a first step of detecting the amount of eccentricity of laundry in a drum to determine whether the laundry is a single load or a multiple load, after a washing operation is performed, and then water is drained out of the drum; a second step of carrying out a spin-drying action based on the determined load amount and performing a rinsing operation; a third step of changing the number of eccentricity detections based on the determination as to whether the initially determined load amount is the single load or the multiple load to redetermine the load amount, when the amount of eccentricity is redetected to carry out the spin-drying action; and a fourth step of carrying out a final spin-drying action according to a spin-drying operation after a final rinsing action is carried out.

Preferably, the first step comprises: detecting the amount of eccentricity of the laundry 15 times or more to determine whether the detected amount of eccentricity of the laundry is equal to or greater than a reference value of eccentricity; and determining that the laundry is the single load when the counted number of the detected amount of eccentricity equal to or greater than the reference value of eccentricity is a predetermined value or more and determining that the laundry is the multiple load when the counted number of the detected amount of eccentricity equal to or greater than the reference value of eccentricity is less than the predetermined value.

Preferably, the third step comprises: repeatedly detecting the amount of eccentricity several times, when the initially determined load amount is the single load, to compare the detected amount of eccentricity with the reference value of eccentricity; and determining that the laundry is the single load when the counted number of the detected amount of eccentricity equal to or greater than the reference value of eccentricity is a predetermined value or more and determining that the laundry is the multiple load when the counted number of the detected amount of eccentricity equal to or greater than the reference value of eccentricity is less than the predetermined value such that the second step is performed based on the determined load amount.

Preferably, when the initially determined load amount is the multiple load, the load amount is redetermined at the third step based on the initial load amount determination.

In accordance with another aspect of the present invention, there is provided a method of controlling a washing machine, comprising: a first step of rotating a drum for a predetermined period of time, after water is drained out of the drum, to detect the amount of laundry received in the drum; a second step of, when the laundry amount is small as the result of the detection, detecting a value of eccentricity of the laundry in the drum to determine whether the laundry is a single load or a multiple load; and a third step of redetecting the value of eccentricity based on the determination as to whether the laundry is the single load or the multiple load to compare the redetected value of eccentricity with a reference value of eccentricity for the single load or the multiple load such that a spin-drying action is carried out based on the result of the comparison.

Preferably, the second step comprises: determining that the laundry is the multiple load without performing additional determination as to whether the laundry is the single load or the multiple load when the detected laundry amount is large and detecting the value of eccentricity to determine whether the detected value of eccentricity is equal to or greater than the reference value of eccentricity when the detected laundry amount is small.

In accordance with yet another aspect of the present invention, there is provided a method of controlling a washing machine, comprising: a first step of detecting load amount of laundry received in a drum, after water is drained out of the drum, to determine whether the load amount is a single load or a multiple load; a second step of detecting the amount of eccentricity of the laundry in the drum, when it is determined that the load amount is the single load, to compare the detected amount of the eccentricity with a reference value of eccentricity; a third step of performing the next operation or determining whether the detected value of eccentricity is a value of eccentricity within a resonance band based on the result of the comparison; and a fourth step of, when the detected value of eccentricity is the value of eccentricity within the resonance band, rotating the drum at revolutions per minute set within the resonance band for a predetermined period of time such that a temporary spin-drying action is carried out to dry the laundry.

Preferably, a rinsing or final spin-drying action of the next operation is carried out at the third step when the detected value of eccentricity is less than the reference value of eccentricity, and it is determined at the third step whether the detected value of eccentricity is the value of eccentricity within the resonance band when the detected value of eccentricity is equal to or greater than the reference value of eccentricity.

Preferably, the value of eccentricity within the resonance band is set to prevent collision of the drum with an outer case of the washing machine due to vibration or noise generated when the spin-drying action is carried out by the eccentricity of the laundry.

Preferably, the fourth step comprises: rotating the drum at revolutions per minute set according to the resonance band for the predetermined period of time such that the temporary spin-drying action is carried out to dry the laundry when the detected value of eccentricity is the value of eccentricity within the resonance band as the result of the determination of the third step, and repeating the second step when the detected value of eccentricity is not the value of eccentricity within the resonance band; and temporarily stopping the operation of the washing machine and repeating the second step.

When it is determined whether the laundry is a single load or a multiple load through the eccentricity detection, the eccentricity detection is differently carried out based on the number of eccentricity detections and the determined load at the initial determination, and the drum is rotated at low speed for a predetermined period of time based on the detected value of eccentricity for the single load such that the temporary spin-drying action is carried out to dry the laundry received in the drum. Consequently, the present invention has the effect of reducing time required until the spin-drying entry is initiated after the water is drained and time required to carry out the eccentricity detection, reducing total washing time of the washing machine, and therefore, reducing energy consumption, i.e., improving energy efficiency.

Furthermore, it is determined whether the laundry is a single load or a multiple load only when the laundry amount is small, the present invention has the effect of preventing incorrect determination as to whether the laundry is a single load or a multiple load. In addition, the present invention has the effect of preventing the washing machine from overheating while the drum is rotated at high speed due to excessive eccentricity generated when the laundry is the single load and when the laundry amount is large.

BRIEF DESCRIPTION OF THE DRAWINGS

The above and other objects, features and other advantages of the present invention will be more clearly understood from the following detailed description taken in conjunction with the accompanying drawings, in which.

DESCRIPTION OF THE PREFERRED EMBODIMENTS

Now, preferred embodiments of the present invention will be described in detail with reference to the accompanying drawings.

It should be understood that washing machines according to numerous preferred embodiments of the present invention may be proposed, although only the most preferred embodiments of the present invention will be described hereinafter.

Figure 1:
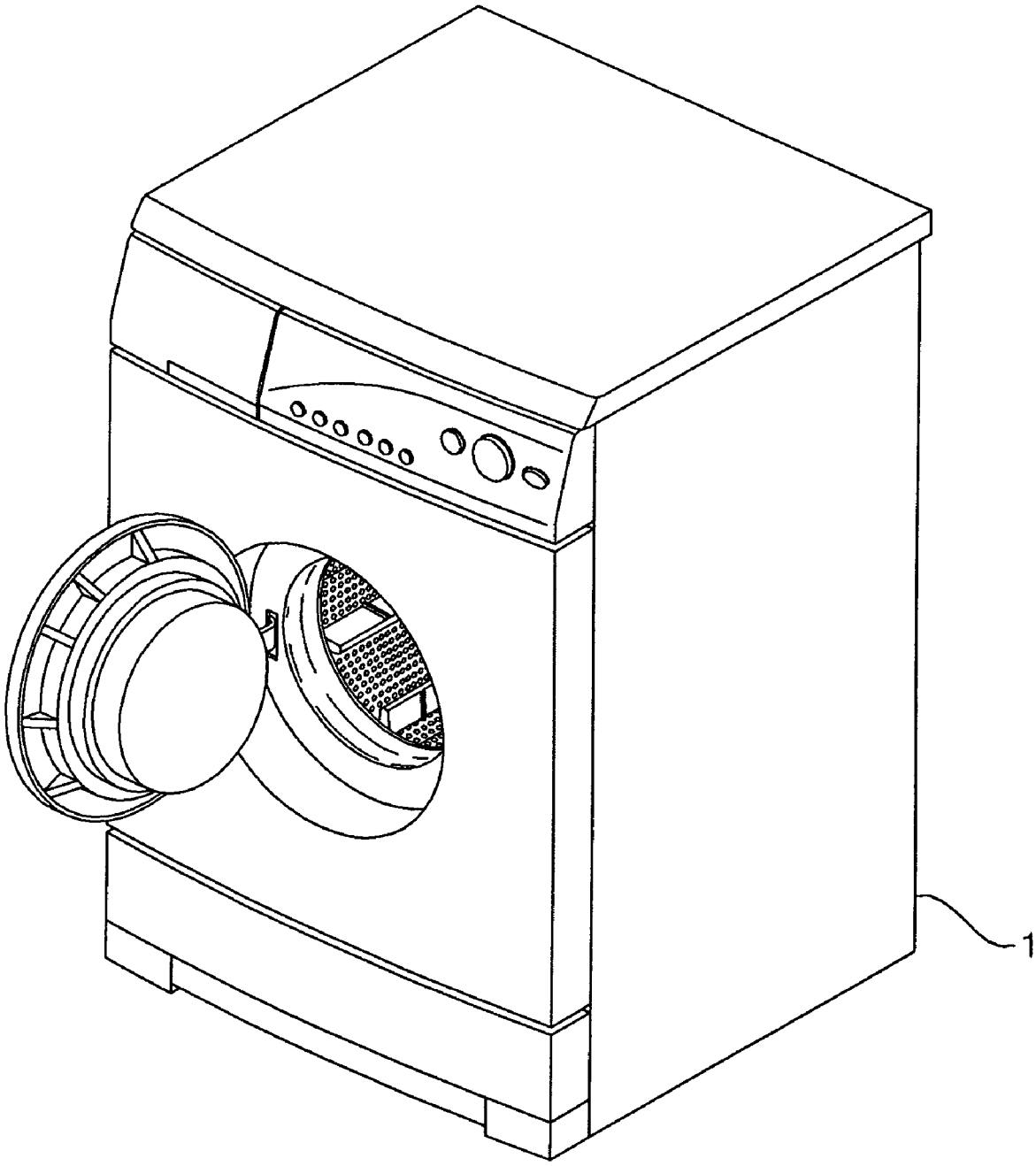
FIG. 1 (Prior Art)
FIG. 1 is a perspective view showing the structure of a conventional washing machine.
Figure 2:
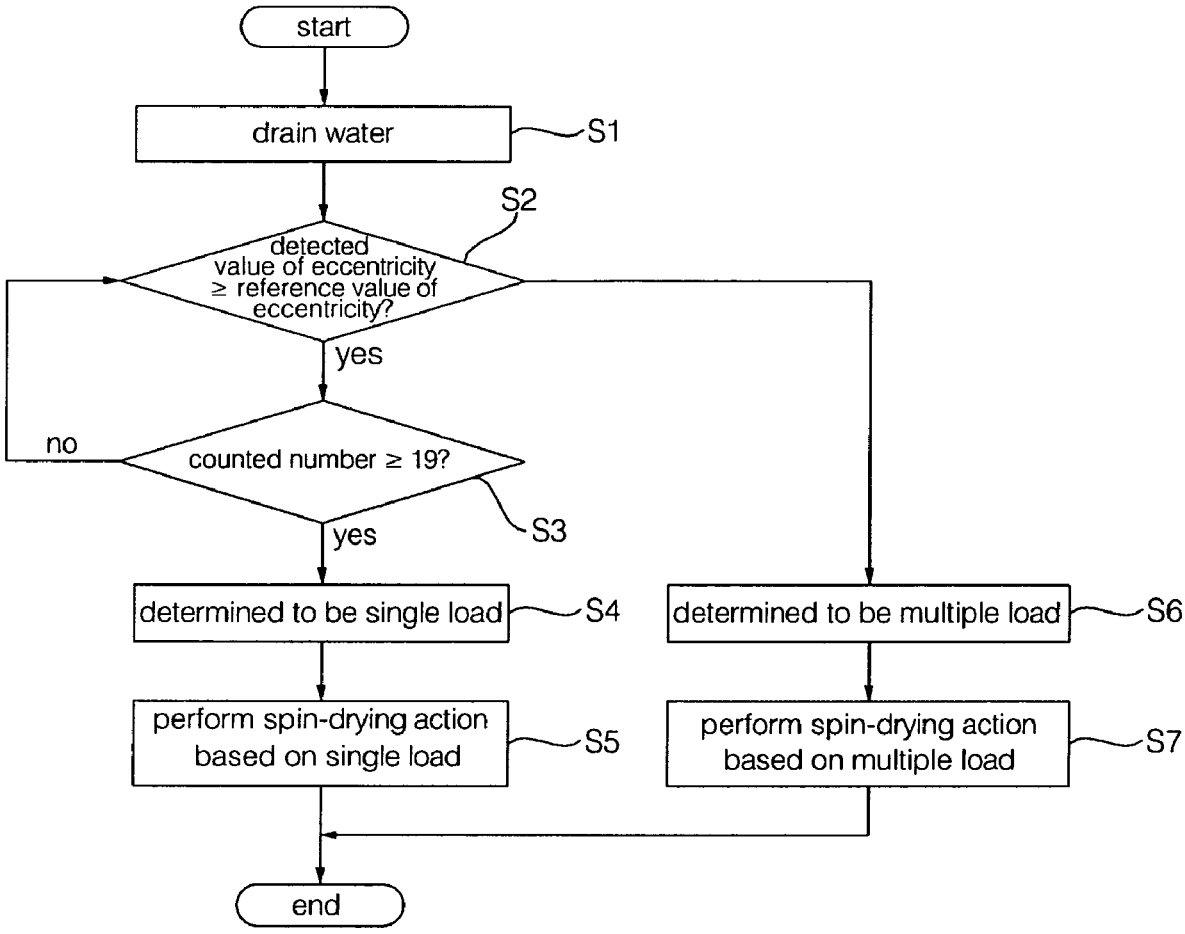
FIG. 2 (Prior Art)
FIG. 2 is a flow chart illustrating a load determining process of the conventional washing machine.
Figure 3:
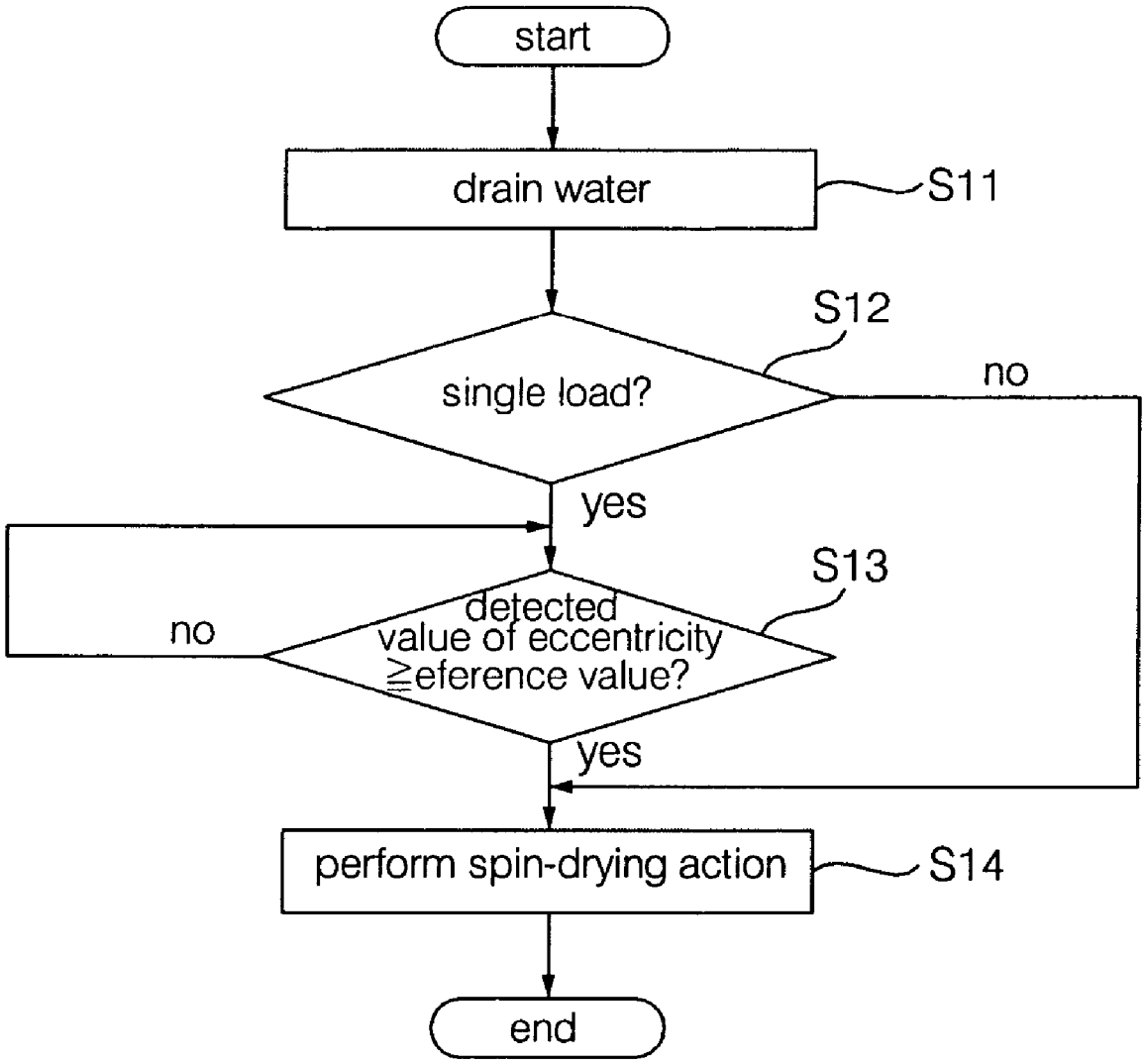
FIG. 3 (Prior Art)
FIG. 3 is a flow chart illustrating a spin-drying entry process of the conventional washing machine in the case of a single load.
Figure 4:
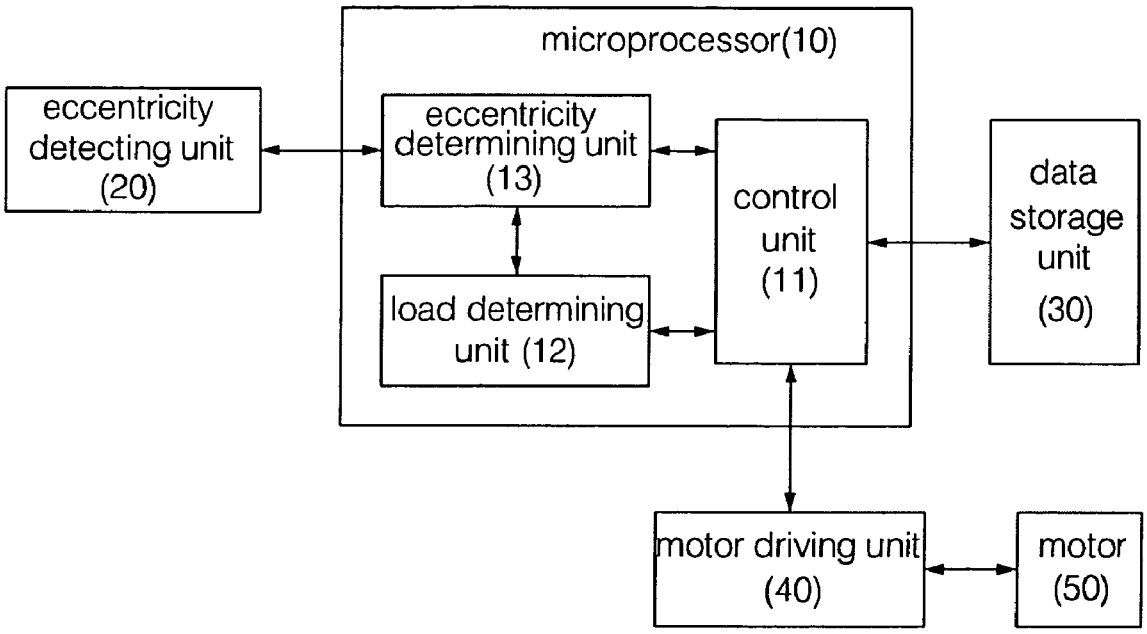
FIG. 4 is a block diagram showing the construction of a washing machine according to a first preferred embodiment of the present invention.
Figure 5:
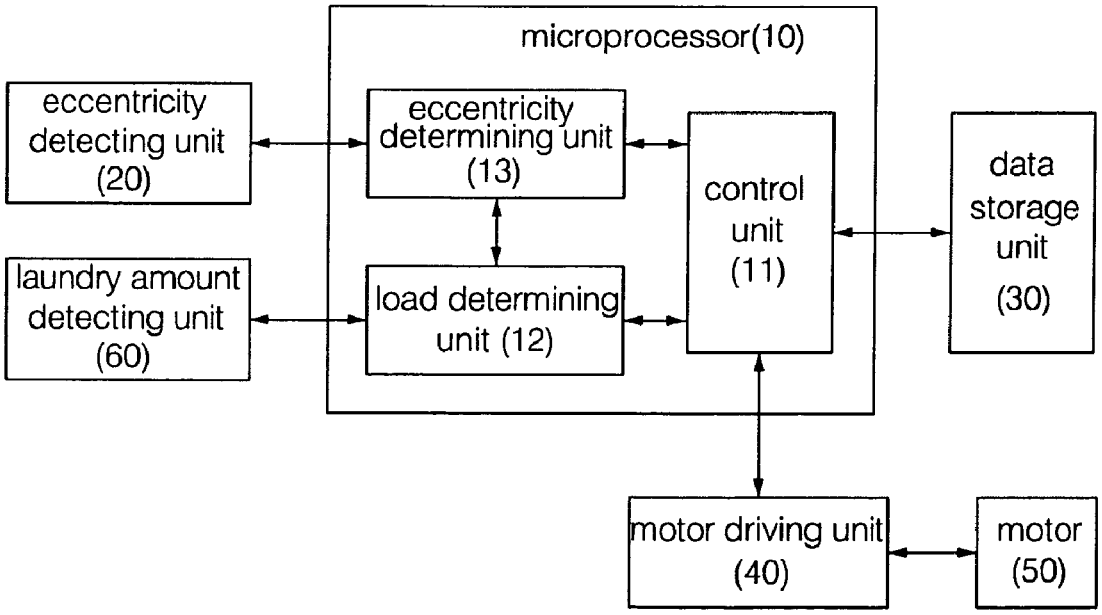
FIG. 5 is a block diagram showing the construction of a washing machine according to a second preferred embodiment of the present invention.
Figure 6:
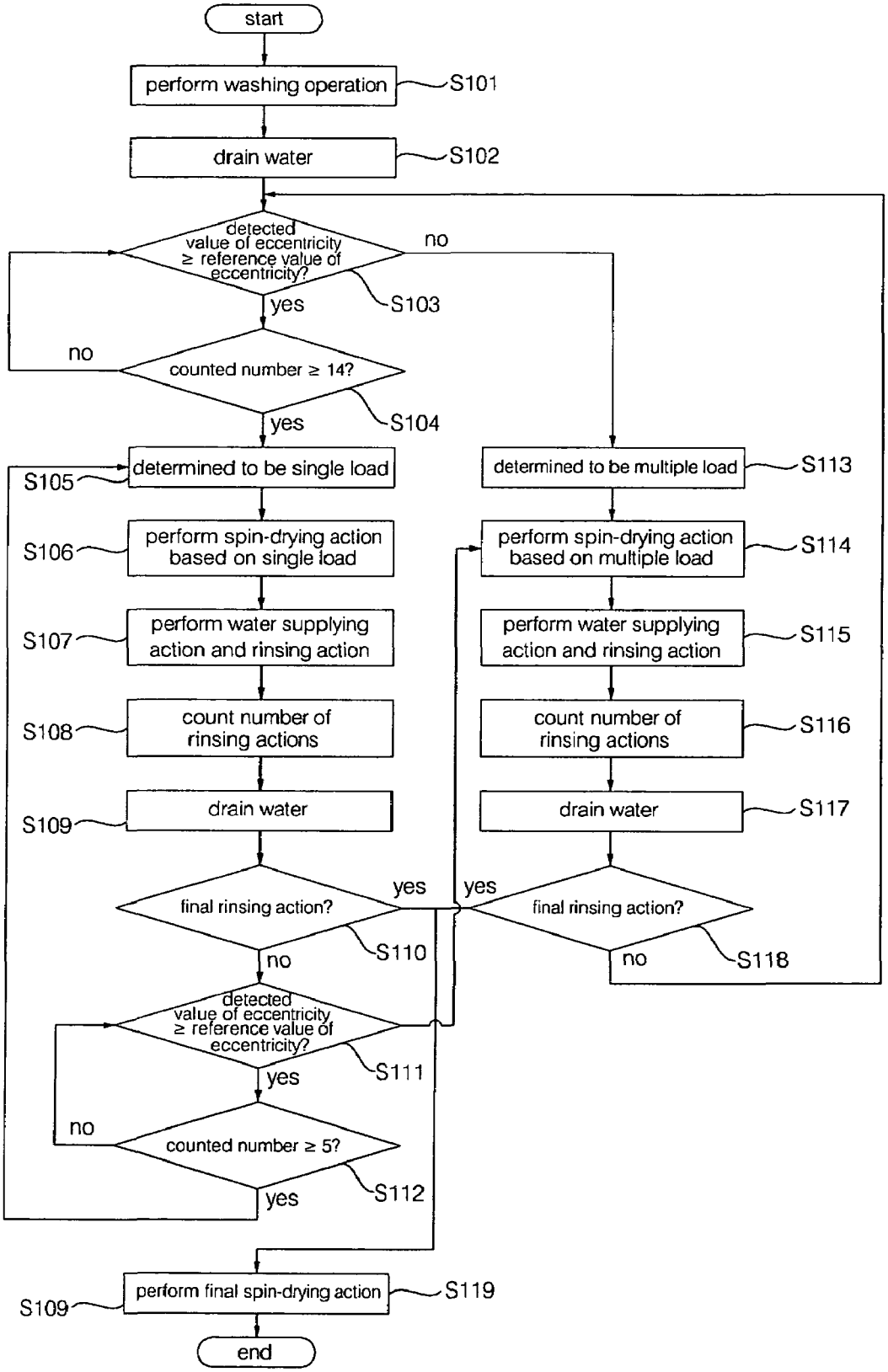
FIG. 6 is a flow chart illustrating a load determining process of the washing machine according to a first preferred embodiment of the present invention.
Figure 7:
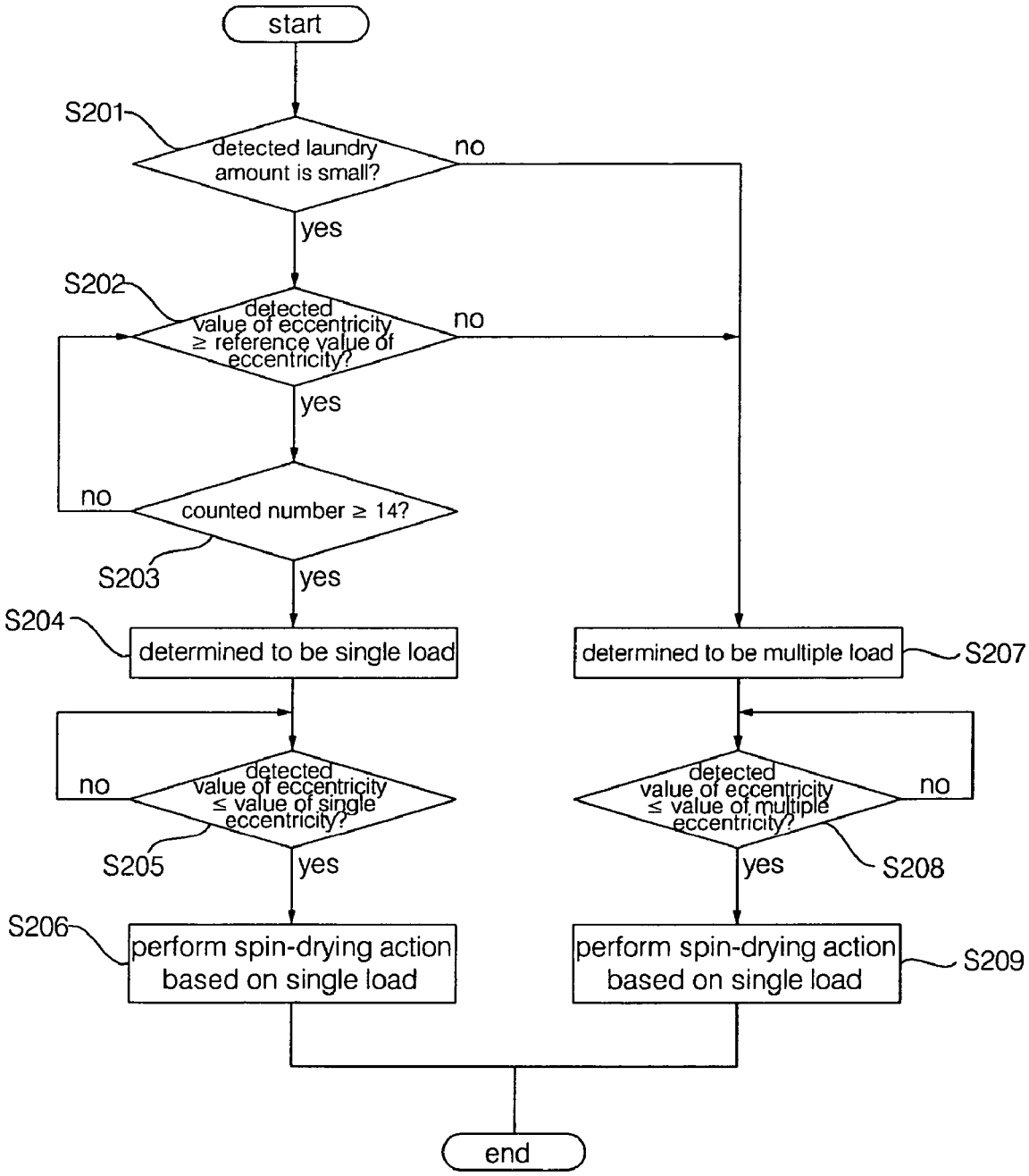
FIG. 7 is a flow chart illustrating a load determining process of the washing machine according to a second preferred embodiment of the present invention.
Figure 8:
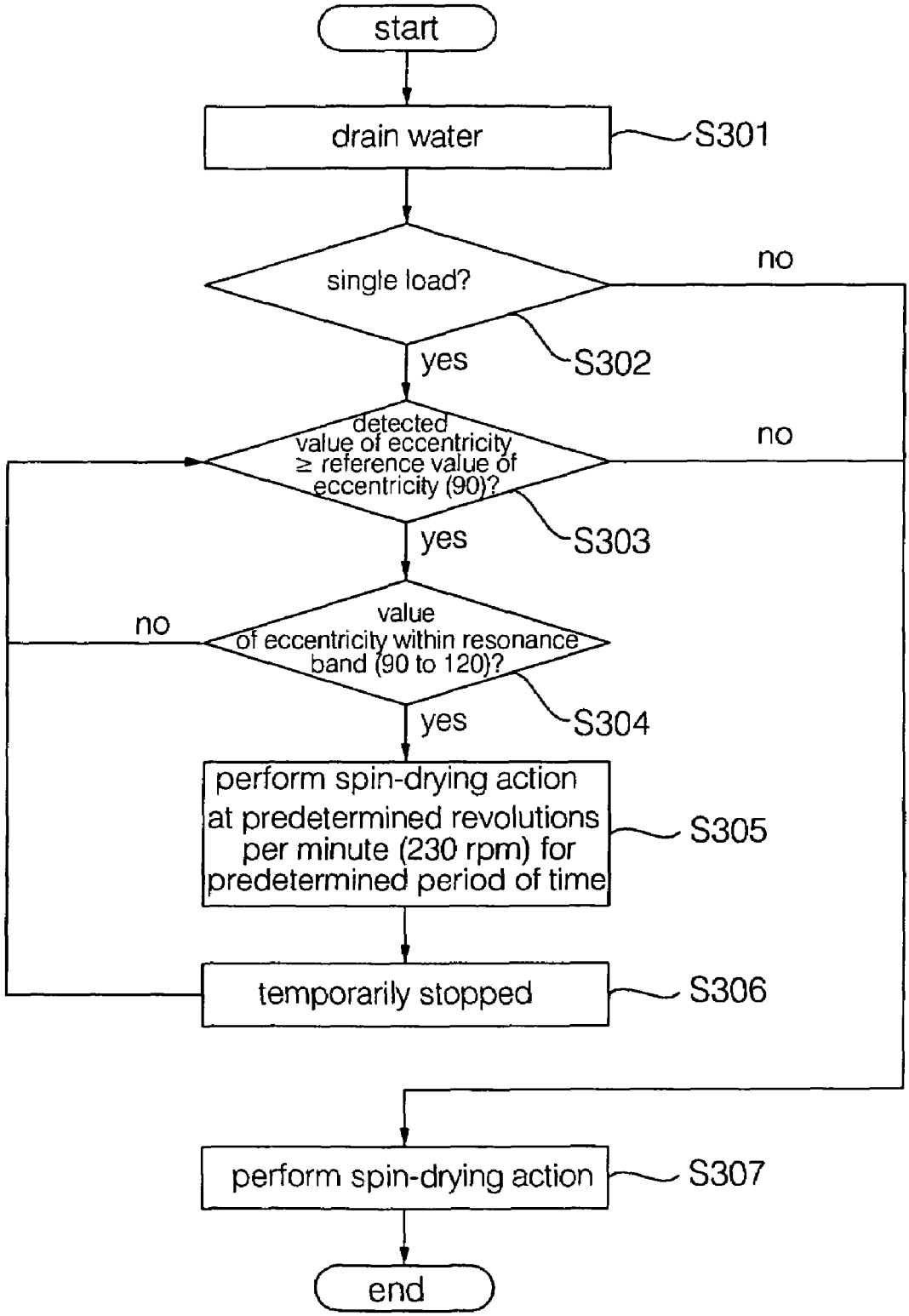
FIG. 8 is a flow chart illustrating a spin-drying entry process of the washing machine according to the present invention.

FIG. 4 is a block diagram showing the construction of a washing machine according to a first preferred embodiment of the present invention, FIG. 5 is a block diagram showing the construction of a washing machine according to a second preferred embodiment of the present invention, FIG. 6 is a flow chart illustrating a load determining process of the washing machine according to a first preferred embodiment of the present invention, FIG. 7 is a flow chart illustrating a load determining process of the washing machine according to a second preferred embodiment of the present invention, and FIG. 8 is a flow chart illustrating a spin-drying entry process of the washing machine according to the present invention.

Referring to FIG. 4, the washing machine according to the first preferred embodiment of the present invention comprises: a motor 50 for rotating a drum (not shown) such that laundry received in the drum is washed; a motor driving unit 40 for driving and controlling the motor 50; an eccentricity detecting unit 20 for detecting eccentricity of the laundry in the drum due to tangling or bias of the laundry; and a microprocessor 10 for determining whether the laundry is a single load or a multiple load based on the value of eccentricity detected by the eccentricity detecting unit 20 and transmitting a control command to the motor driving unit 40 to change the operation of the motor 50.

The washing machine further comprises: a data storage unit 30 for storing reference value data based on the determination as to whether the laundry is a single load or a multiple load, which is performed by the microprocessor 10; an input unit (not shown) for setting washing courses, the amount of water to be supplied, and the temperature of water to be supplied in a washing/rinsing/spin-drying operation to remove contaminants from the laundry; and a display unit (not shown) for displaying the operation of the washing machine.

Specifically, the data storage unit 30 serves to store reference value data used for the microprocessor 10 to determine whether the value of eccentricity detected by the eccentricity detecting unit 20 is equal to or greater than the reference value, operation data, by which the motor 50 is differently operated, and data generated while the washing operation is performed.

The eccentricity detecting unit 20 serves to detect eccentricity of the laundry based on the change in revolutions per minute of the motor 50 generated as the laundry received in the drum is brought into contact with the inner wall of the drum by centrifugal force generated when the drum is rotated.

The motor 50 is controlled to be driven at predetermined revolutions per minute by the motor driving unit 40. However, when the laundry is brought into contact with the inner wall of the drum, and therefore, revolutions per minute of the motor 50 is changed due to the eccentricity of the laundry, the eccentricity detecting unit 20 measures ripple in revolutions per minute of the motor 50 to detect the value of eccentricity based on the change in revolutions per minute of the motor 50.

If eccentricity is generated due to tangling of the laundry in the drum when the water supplying action, the water draining action, and the spin-drying action are carried out while the washing operation or the rinsing operation of the washing machine is performed, vibration or noise may be generated from the washing machine, and furthermore, the washing machine may overheat during the spin-drying action, in which the drum is rotated at high speed. For this reason, the microprocessor 10 detects the eccentricity of the laundry in the drum before carrying out the spin-drying action.

Also, the microprocessor 10 transmits a control command to the motor driving unit 40 to drive the motor at predetermined revolutions per minute such that the value of eccentricity can be detected by the eccentricity detecting unit 20.

At this time, the motor driving unit 40 drives the motor 50 at the predetermined revolutions per minute based on the control command transmitted from the microprocessor 10. Specifically, the motor driving unit 40 drives the motor at 100 to 110 rpm such that the value of eccentricity can be detected by the eccentricity detecting unit 20.

The microprocessor 10 determines whether the laundry is a single load or a multiple load based on the results of detection performed by the eccentricity detecting unit 20, and creates a control command to change the washing operation, revolutions per minute of the motor 50, or the number of eccentricity detections.

The microprocessor 10 comprises: an eccentricity determining unit 13 for determining whether the value of eccentricity detected by the eccentricity detecting unit 20 is equal to or greater than the predetermined reference value of eccentricity; a load determining unit 12 for determining whether the laundry is a single load or a multiple load based on the result of determination performed by the eccentricity determining unit 13; and a control unit 11 for controlling the operation of the motor 50 based on the determined load.

The eccentricity determining unit 13 serves to compare the value of eccentricity detected by the eccentricity detecting unit 20 with the reference value of eccentricity stored in the data storage unit 30 to determine whether the value of eccentricity is equal to or greater than the reference value of eccentricity.

The load determining unit 12 serves to count the detected value of eccentricity whenever the eccentricity determining unit 13 determines that the detected value of eccentricity is equal to or greater than a predetermined reference value of eccentricity, and to determine that the laundry is a single load when the counted number of the detected value of eccentricity equal to or greater than the predetermined reference value of eccentricity is 14 or more after the eccentricity detecting process is performed 15 times or more.

When it is determined that the laundry is a single load or a multiple load as described above, the control unit 11 transmits a control signal to the motor driving unit 40 such that the motor 50 is differently rotated based on the determination as to whether the laundry is a single load or a multiple load, and the motor driving unit 40 drives the motor 50 according to the control signal received from the control unit 11.

When the laundry is a single load, the control unit 11 performs a controlling operation such that the spin-drying action is carried out at revolutions per minute of the motor set based on the single load. When the laundry is a multiple load, on the other hand, the control unit 11 performs a controlling operation such that the spin-drying action is carried out at revolutions per minute of the motor set based on the multiple load.

When it is redetermined whether the laundry is a single load or a multiple load while the set washing operation is performed after carrying out the initial determination as to whether the laundry is a single load or a multiple load, the control unit 11 differently sets the number of eccentricity detections based on the initial determination as to whether the laundry is a single load or a multiple load.

When it is determined that the laundry is a single load as a result of the initial determination as to whether the laundry is a single load or a multiple load, the control unit 11 sets a reference value, by which it is determined whether the laundry is a single load or a multiple load, to 5. Consequently, when the counted number of the detected value of eccentricity equal to or greater than the predetermined reference value of eccentricity is 5 or more, the load determining unit 12 determines that the laundry is a single load.

When the load determining unit 12 determines that the laundry is the single load as described above, eccentricity of the laundry is detected by the eccentricity detecting unit 20 to determine whether a spin-drying entry process can be performed.

At this time, the eccentricity determining unit 13 compares the value of eccentricity detected by the eccentricity detecting unit 20 with the reference value of eccentricity for the single load stored in the data storage unit 30 to determine the degree of eccentricity.

When the detected value of eccentricity is equal to or greater than the reference value of eccentricity for the single load, the eccentricity determining unit 13 also determines whether the value of eccentricity is within a resonance band.

If the eccentricity determining unit 13 determines that the detected value of eccentricity is within the resonance band, the motor 50 is driven at the predetermined revolutions per minute based on the operation data of the data storage unit 30 under the control of the control unit 11, and then the eccentricity is redetected by the eccentricity detecting unit 20 under the control of the control unit 11. At this time, the motor 50 is rotated at 230 rpm under the control of the control unit 11 such that the temporary spin-drying action is carried out to dry the laundry.

At this time, the motor driving unit 40 drives the motor 50 at a low revolutions per minute for a predetermined period of time according to the control command of the control unit 11 such that the temporary spin-drying action is carried out by the rotation of the drum to dry the laundry.

Referring to FIG. 5, the washing machine according to the second preferred embodiment of the present invention comprises: a motor 50 for rotating a drum (not shown); a motor driving unit 40 for driving and controlling the motor 50; an eccentricity detecting unit 20; a laundry amount detecting unit 60 for detecting the amount of laundry received in the drum; and a microprocessor 10 for determining whether the laundry is a single load or a multiple load based on the value of eccentricity detected by the eccentricity detecting unit 20 or the laundry amount detected by the laundry amount detecting unit 60 and transmitting a control command to the motor driving unit 40 to change the operation of the motor 50.

The washing machine further comprises: a data storage unit 30 for storing reference value data based on the determination as to whether the laundry is a single load or a multiple load, which is performed by the microprocessor 10; an input unit (not shown); and a display unit (not shown).

It should be noted that components of the washing machine according to the second preferred embodiment of the present invention, which correspond to those of the washing machine according to the first preferred embodiment of the present invention, are indicated by the same reference numerals as those of the washing machine according to the first preferred embodiment of the present invention, and a detailed description thereof will not be given.

The data storage unit 30 serves to store reference value data used to determine whether the laundry amount detected by the laundry amount detecting unit 60 is large or small, operation data of the motor 50, and data generated while the washing operation is performed.

The laundry amount detecting unit 60 serves to measure time taken until the drum reaches a predetermined speed after the drum is rotated at low speed for a predetermined period of time and time taken until the drum is stopped after the motor 50 is stopped to detect the laundry amount.

When the water supplying action, the water draining action, and the spin-drying action are carried out while the washing operation or the rinsing operation of the washing machine is performed, the laundry amount detecting unit 60 detects the amount of the laundry received in the drum, under the control of the microprocessor 10, to set the amount of water supplied and washing courses and to determine whether the laundry is a single load or a multiple load.

At this time, the microprocessor 10 transmits a control command to the motor driving unit 40 to drive the motor 50 at predetermined revolutions per minute such that the laundry amount is detected by the laundry amount detecting unit 60 and to stop the motor 50 after a predetermined period of time.

The microprocessor 10 determines whether the laundry is a single load or a multiple load based on the results of detection performed by the eccentricity detecting unit 20 and the laundry amount detecting unit 60, and creates a control command to change the washing operation, revolutions per minute of the motor 50, or the number of eccentricity detections.

The microprocessor 10 comprises: an eccentricity determining unit 13 for determining whether the value of eccentricity detected by the eccentricity detecting unit 20 is equal to or greater than the predetermined reference value of eccentricity; a load determining unit 12 for determining whether the laundry amount is small or large based on the laundry amount detected by the laundry amount detecting unit 60 and determining whether the laundry is a single load or a multiple load based on the value of eccentricity detected by the eccentricity detecting unit 20; and a control unit 11 for controlling the operation of the motor 50 based on the determined load.

When determining whether the laundry amount detected by the laundry amount detecting unit 60 is small or large, the load determining unit 12 determines that the detected laundry amount is small if ripple generated when the laundry amount is detected is equal to or less than 4300 pluses. On the other hand, the load determining unit 12 determines that the detected laundry amount is large if ripple generated when the laundry amount is detected is greater than 4300 pluses.

If it is determined that the amount of the laundry received in the drum is large, the load determining unit 12 determines that the laundry is a multiple load without performing additional determination as to whether the laundry is a single load.

If the load determining unit 12 determines that the detected laundry amount is small, the eccentricity detecting unit 20 detects the degree of eccentricity of the laundry in the drum a predetermined number of times. If the counted number of the detected value of eccentricity equal to or greater than the predetermined reference value of eccentricity is 14 or more, the load determining unit 12 determines that the laundry is a single load.

When the load determining unit 12 determines that the laundry is a single load or a multiple load based on the detected laundry amount and the detected value of eccentricity, the eccentricity detecting unit 20 detects eccentricity of the laundry to determine, under the control of the control unit 11, whether the spin-drying entry is possible.

When the eccentricity determining unit 13 determines the detected value of eccentricity, the eccentricity determining unit 13 determines the detected value of eccentricity based on the reference value of eccentricity, which is different according to the determination as to whether the laundry is a single load or a multiple load, which is determined by the load determining unit 12.

When the laundry is a single load, for example, the eccentricity determining unit 13 compares the detected value of eccentricity with the reference value of eccentricity for the single load stored in the data storage unit 30. When the laundry is a multiple load, on the other hand, the eccentricity determining unit 13 compares the detected value of eccentricity with the reference value of eccentricity for the multiple load stored in the data storage unit 30.

If the detected value of eccentricity is equal to or less than the reference value of eccentricity for the single load, the control unit 11 transmits a control command to the motor driving unit 40 to carry out the spin-drying action based on the load amount.

When the laundry is a single load, for example, the spin-drying action is carried out at revolutions per minute of the motor set based on the single load. When the laundry is a multiple load, on the other hand, the spin-drying action is carried out at revolutions per minute of the motor set based on the multiple load.

Now, a method of controlling the washing machine with the above-stated construction according to the present invention will be described in detail with reference to FIGS. 6 to 8.

First, a load determining process of the washing machine according to a first preferred embodiment of the present invention will be described with reference to FIG. 6.

As illustrated in FIG. 6, washing information, such as a washing course, an amount of water to be supplied, kind of water supply, etc., is input to perform a washing/rinsing/spin-drying operation (S101).

After the washing operation is completed, the water is drained out of the drum, and then eccentricity of the laundry in the drum is detected to minimize vibration or noise generated when a spin-drying action is carried out due to tangling or bias of the laundry in the drum before the rinsing operation is initiated (S102, S103).

The motor, by which the drum is rotated, is driven at low speed such that the motor is driven at a predetermined speed for a predetermined period of time. At this time, the washing machine measures ripple in revolutions per minute of the motor. The ripple in revolutions per minute of the motor is greatly changed according to the degree of eccentricity of the laundry in the drum, and therefore, the value of eccentricity is detected based on the change in revolutions per minute of the motor.

The washing machine detects the value of eccentricity of the laundry in the drum a predetermined number of times or more to determine whether the detected value of eccentricity is equal to or greater than the reference value of eccentricity. If the detected value of eccentricity is equal to or greater than the reference value of eccentricity, the washing machine determines whether the laundry is a single load or a multiple load based on the counted number of the detected value of eccentricity equal to or greater than the predetermined reference value of eccentricity (S104).

Preferably, the washing machine detects the value of eccentricity of the laundry in the drum 15 times or more, and the washing machine determines that the laundry is a single load when the counted number of the detected value of eccentricity equal to or greater than the predetermined reference value of eccentricity is 14 or more after the eccentricity detecting process is performed 15 times or more.

It should be noted that the reference value of eccentricity is set based on vibration or noise generated when the drum is rotated by the motor. Preferably, the approximately 70 to 80% of the detected value of eccentricity is set as the reference value of eccentricity.

Consequently, the detected value of eccentricity in the case of a single load is greater than the detected value of eccentricity in the case of a multiple load, and therefore, it is determined that the laundry is a single load when the detected value of eccentricity is equal to or greater than the predetermined reference value of eccentricity, and that the laundry is a multiple load when the detected value of eccentricity is less than the predetermined reference value of eccentricity.

When the detected value of eccentricity is equal to or greater than the predetermined reference value of eccentricity, and the counted number of the detected value of eccentricity equal to or greater than the predetermined reference value of eccentricity is 14 or more, for example, it is determined that the laundry is a single load. When the detected value of eccentricity is less than the predetermined reference value of eccentricity, or the counted number of the detected value of eccentricity equal to or greater than the predetermined reference value of eccentricity is less than 14, on the other hand, it is determined that the laundry is a multiple load (S105, S113).

When it is determined that the laundry is the single load as described above, the washing machine rotates the drum at revolutions per minute set based on the single load to carry out a spin-drying action (S106).

When it is determined that the laundry is the single load, and when the detected value of eccentricity of the laundry in the drum is not less than the reference value of eccentricity and not greater than 85, the motor is driven at 700 to 900 rpm.

When it is determined that the laundry is the single load, and when the detected value of eccentricity of the laundry in the drum is from 85 to 95, the motor is driven at a low speed of 700 rpm or less to prevent vibration and noise from being generated due to the eccentricity of the laundry in the drum and to prevent the washing machine from overheating.

Especially when it is determined that the laundry is the single load, and when the detected value of eccentricity of the laundry in the drum is very large, the motor is preferably driven at 600 rpm.

After the spin-drying action is completed, water, which will be used for a subsequent rinsing operation, is supplied into the drum. When the water is supplied into the drum up to a predetermined water level, a rinsing action is carried out (S107).

The rinsing action is carried out a predetermined number of times, which is set by a user, and then the number of the rinsing actions is counted. Subsequently, the water is drained out of the drum (S108, S109).

After the water is drained out of the drum, the eccentricity of the laundry in the drum is redetected such that the spin-drying entry is initiated. Before the eccentricity of the laundry in the drum is detected, the counted number of the rinsing actions is compared with the predetermined number of rinsing actions to determine whether the final rinsing action is carried out (S110).

According to the present invention, the determination as to whether the final rinsing action is carried out is performed after the rinsing action is carried out, although determination as to whether the final rinsing action is carried out may be performed even before the rinsing action is carried out after the determination as to whether the laundry is a single load or a multiple load is performed.

If the rinsing action is not completed, the eccentricity of the laundry in the drum is redetected to determine whether the laundry is a single load or a multiple load (S111).

When the eccentricity of the laundry in the drum is redetected after the initial detection of eccentricity is performed, and when the initially determined load is the single load, the eccentricity of the laundry in the drum is detected within the number of eccentricity detections less than when the initial detection of eccentricity is performed.

Specifically, the eccentricity of the laundry in the drum is redetected after it is determined that the laundry is the single load. Consequently, the eccentricity of the laundry in the drum is detected within the number of eccentricity detections less than 15. Preferably, the number of eccentricity detections is equal to or greater than 5.

When the counted number of the detected value of eccentricity equal to or greater than the predetermined reference value of eccentricity is 4 or more after the eccentricity detecting process is performed 5 times or more, it is determined that the laundry is a single load. When the detected value of eccentricity is less than the predetermined reference value of eccentricity or the counted number of the detected value of eccentricity equal to or greater than the predetermined reference value of eccentricity is less than 4 after the eccentricity detecting process is performed 5 times or more, on the other hand, it is determined that the laundry is a multiple load (S112).

When it is determined that the laundry is the single load, the spin-drying action is carried out at revolutions per minute of the motor set based on the single load. Subsequently, the rinsing action is carried out, and then redetermination as to whether the final rinsing action is completed is repeatedly carried out (S105 to S110).

If it is determined that the laundry is the multiple load when the initial detection of eccentricity is performed, the motor is rotated at revolutions per minute of the motor set based on the multiple load such that the spin-drying action is carried out. At this time, the revolutions per minute of the motor are differently set based on the detected value of eccentricity (S114).

Specifically, the revolutions per minute of the motor are changed when the value of eccentricity is less than 45, when the value of eccentricity is from 45 to 55, and when the value of eccentricity is from 55 to 60. When the value of eccentricity is less than 45, the motor is driven at 1000 rpm. When the value of eccentricity is from 45 to 55, the motor is driven at 700 to 800 rpm. When the value of eccentricity is from 56 to 60, the motor is driven at 600 to 700 rpm.

After the spin-drying action is carried out based on the multiple load, water, which will be used for a subsequent rinsing action, is supplied into the drum, and then the rinsing action is carried out. Subsequently, the number of the rinsing actions is counted as in the case of the single load (S115, S116).

After the rinsing action is carried out, the water is drained out of the drum. Subsequently, the counted number of the rinsing actions is compared with the predetermined number of rinsing actions to determine whether the final rinsing action is carried out (S117, S118).

If it is determined that the rinsing action is not completed after the determination of the final rinsing action, the eccentricity of the laundry in the drum is redetected. At this time, the number of eccentricity detections is equal to the number of initial eccentricity detections, and the criterion of determination as to whether the laundry is a single load or a multiple load is the same as the criterion of determination during the initial detection of eccentricity (S103).

In the case that a water supplying action, a rinsing action, or a spin-drying action is carried out for the rinsing operation based on the multiple load, it is determined that the laundry is a single load when the counted number of the detected value of eccentricity equal to or greater than the predetermined reference value of eccentricity is 14 or more after the eccentricity detecting process is performed 15 times or more, and that the laundry is a multiple load when the detected value of eccentricity is less than the predetermined reference value of eccentricity, or the counted number of the detected value of eccentricity equal to or greater than the predetermined reference value of eccentricity is less than 14 after the eccentricity detecting process is performed 15 times or more (S104).

When it is determined that the final rinsing action is completed, the spin-drying action is carried out based on the determined load. After the rinsing operation is performed, the spin-drying operation is performed to carry out a final spin-drying action (S119).

A load determining process of the washing machine according to a second preferred embodiment of the present invention is illustrated in FIG. 7. The load determining process of the washing machine according to the second preferred embodiment of the present invention is a process of determining whether the laundry is a single load or a multiple load based on the laundry amount.

When a washing course is set by a user, the washing machine performs a washing/rinsing/spin-drying operation. While each of the above-described operations is performed, a water supplying action, a water draining action, and a spin-drying action are repeatedly carried out to perform the washing operation. When the supplied water is drained, and then the spin-drying action is carried out, the spin-drying action is differently set according to the amount of the laundry received in the drum. For this reason, a load determining process is performed.

Before the load determining process is performed, the drum is rotated at a predetermined speed to detect the amount of the laundry received in the drum (S201).

When the detected laundry amount is greater than a predetermined value, it is determined that the laundry amount is small. When the detected laundry amount is equal to or less than the predetermined value, on the other hand, it is determined that the laundry amount is large. Preferably, it is determined that the laundry amount is small if ripple generated when the laundry amount is detected is equal to or less than 4300 pluses.

When it is determined that the laundry amount is small, the degree of eccentricity of the laundry in the drum is detected a predetermined number of times or more, and the detected value of eccentricity is compared with the reference value of eccentricity to determine whether the laundry is a single load or a multiple load (S202).

At this time, the washing machine detects the value of eccentricity of the laundry in the drum 15 times or more, and then the washing machine determines that the laundry is a single load when the counted number of the detected value of eccentricity equal to or greater than the predetermined reference value of eccentricity is 14 or more, and that the laundry is a multiple load when the counted number of the detected value of eccentricity equal to or greater than the predetermined reference value of eccentricity is less than 14 (S203, S204, S207).

When it is determined that the laundry is the single load, the value of eccentricity is redetected to determine whether the detected value of eccentricity is equal to or less than the value of single eccentricity (S205).

At this time, the value of single eccentricity is a reference value of eccentricity, at which excessive vibration or noise due to the eccentricity of the laundry in the drum is prevented from being generated from the washing machine when the spin-drying action is carried out. Especially, the value of single eccentricity is a value of eccentricity, at which the drum is effectively prevented from colliding with a case of the washing machine when the drum is rotated.

The value of single eccentricity is set to a value satisfying the above condition among the values of eccentricity generated based on the single load. Preferably, the value of single eccentricity is set to 90.

When the detected value of eccentricity is equal to or less than 90, the motor is driven at revolutions per minute set based on the single load, and then the spin-drying action is carried out in the washing machine.

When the laundry amount detected by the laundry amount detection is large, on the other hand, it is determined that the laundry is a multiple load without performing additional determination as to whether the laundry is a single load or a multiple load (S207).

When it is determined that the laundry is the multiple load as a result of the laundry amount detection and eccentricity detection as described above, a procedure set based on the multiple load is carried out. At this time, eccentricity of the laundry in the drum is detected to determine whether the detected value of eccentricity is equal to or less than the value of multiple eccentricity (S208).

If the detected value of eccentricity for the single/multiple load is greater than the value of single/multiple eccentricity, the eccentricity detection is repeatedly performed until the value of eccentricity for the single/multiple load is equal to or less than the value of single/multiple eccentricity.

When the condition of the value of single/multiple eccentricity is satisfied according to the results determined by the laundry amount detection and the eccentricity detection as described above, the motor is driven at revolutions per minute set based on the single/multiple load, and then the spin-drying action is carried out (S206, S209).

FIG. 8 is a flow chart illustrating a spin-drying entry process of the washing machine according to the present invention.

As illustrated in FIG. 8, a washing operation is performed according to a washing course set by a user, and then water is drained out of the drum. After the water is drained, a spin-drying action is carried out, which is followed by a rinsing operation. Before the spin-drying action is carried out, the laundry in the drum is detected to determine whether the laundry is a single load or a multiple load (S301).

At this time, the value of eccentricity of the laundry in the drum is repeatedly detected a predetermined number of times. If the detected value of eccentricity is equal to or greater than the predetermined reference value of eccentricity, it is determined that the laundry is a single load. If the detected value of eccentricity is less than the predetermined reference value of eccentricity, it is determined that the laundry is a multiple load (S302).

Especially when the eccentricity of the laundry in the drum is detected 20 times or more, and the counted number of the detected value of eccentricity equal to or greater than 78, which is the predetermined reference value of eccentricity, is 19 or more, it is determined that the laundry is the single load.

When it is determined that the laundry received in the drum is the single load, the value of eccentricity of the laundry in the drum is detected to determine whether the detected value of eccentricity is equal to or greater than the reference value of eccentricity for the single load (S303).

If the detected value of eccentricity is less than the reference value of eccentricity for the single load, it is determined that there is no possibility of generating excessive vibration, and then the spin-drying action is initiated (S307).

If the detected value of eccentricity is equal to or greater than the reference value of eccentricity for the single load, on the other hand, it is determined whether the value of eccentricity is within a resonance band (S304).

The value of eccentricity for the single load is greater that the value of eccentricity for the multiple load. Consequently, it is preferable that the reference value of eccentricity for the single load is set to 90.

Also, the value of eccentricity within the resonance band is set such that the drum is effectively prevented from colliding with the outer case of the washing machine when the spin-drying action is carried out. Preferably, the value of eccentricity within the resonance band is 90 to 120.

When the detected value of eccentricity is greater than the value of eccentricity within the resonance band, the value of eccentricity is repeatedly detected to determine whether the detected value of eccentricity is equal to or greater than the reference value of eccentricity for the single load S303, S304). If the detected value of eccentricity is the value of eccentricity within the resonance band, the motor is driven at the predetermined revolutions per minute for a predetermined period of time such that the temporary spin-drying action is carried out to dry the laundry (S305).

When the detected value of eccentricity is the value of eccentricity within the resonance band, the spin-drying action can be carried out at low speed. Consequently, the motor is driven at low speed for a predetermined period of time such that the temporary spin-drying action is carried out to reduce the weight of the laundry. As a result, the value of eccentricity is decreased when a subsequent eccentricity detection is carried out.

The motor is driven at a speed at the value of eccentricity within the resonance band, at which the outer case of the washing machine is not damaged when the drum is rotated, i.e., the outer case of the washing machine is not damaged due to excessive vibration of the drum.

At this time, the motor is driven at low speed to rotate the drum at 100 to 230 rpm.

After the temporary spin-drying action is carried out as described above, the motor is temporarily stopped (S306). After the rotation of the drum is stopped, the eccentricity of the laundry in the drum is redetected to redetermine whether the redetected value of eccentricity is equal to or less than the reference value of eccentricity for the single load (S303).

The eccentricity detection and the temporary spin-drying action within the resonance band are repeatedly carried out, and therefore, the value of eccentricity of the laundry in the drum is decreased. As a result, the value of eccentricity equal to or less than the reference value of eccentricity for the single load is detected. At this time, the washing machine carries out the spin-drying action.

In the illustrated embodiments, the procedure from the eccentricity detection to the spin-drying entry is applied to the case that the spin-drying action is carried out after the washing operation is performed. In addition, the procedure from the eccentricity detection to the spin-drying entry may be applied to the case that the water supplying action, the water draining action, and the spin-drying action are carried out while the rinsing operation is performed, whereby time required until the spin-drying entry is initiated is considerably reduced.

As apparent from the above description, the present invention has the following effects.

In the washing machine and the method of controlling the same according to the present invention, the number of eccentricity detections is differently set, and the spin-drying action and the eccentricity redetection are differently carried out based on the initially determined load. Consequently, the present invention has the effect of reducing time required until the spin-drying entry is initiated after the water is drained.

If it is determined that the laundry is a single load, the drum is rotated at low speed for a predetermined period of time based on the detected value of eccentricity such that the temporary spin-drying action is carried out to dry the laundry received in the drum. As a result, the eccentricity detection is not unnecessarily repeatedly performed. Consequently, the present invention has the effect of greatly reducing time required until the spin-drying entry is initiated, and decreasing generation of errors when the spin-drying entry is initiated.

In the case of determining load amount of the laundry received in the drum, it is determined whether the laundry is a single load or a multiple load only when the laundry amount is small. Consequently, the present invention has the effect of preventing incorrect determination as to whether the laundry is a single load or a multiple load, and therefore, preventing excessive vibration or noise from being generated from the washing machine. Furthermore, the present invention has the effect of preventing the washing machine from overheating when the spin-drying action is carried out to dry the laundry whose value of eccentricity is large.

When it is determined whether the laundry is a single load or a multiple load through the eccentricity detection, the eccentricity detection is differently carried out based on the number of eccentricity detections and the determined load at the initial determination, and the drum is rotated at low speed for a predetermined period of time based on the detected value of eccentricity for the single load such that the temporary spin-drying action is carried out to dry the laundry received in the drum. Consequently, the present invention has the effect of reducing time required until the spin-drying entry is initiated after the water is drained and time required to carry out the eccentricity detection, reducing total washing time of the washing machine, and therefore, reducing energy consumption, i.e., improving energy efficiency.

Furthermore, it is determined whether the laundry is a single load or a multiple load only when the laundry amount is small. Consequently, the present invention has the effect of preventing incorrect determination as to whether the laundry is a single load or a multiple load. In addition, the present invention has the effect of preventing the washing machine from overheating while the drum is rotated at high speed due to excessive eccentricity generated when the laundry is the single load and when the laundry amount is large.

Although the preferred embodiments of the present invention have been disclosed for illustrative purposes, those skilled in the art will appreciate that various modifications, additions and substitutions are possible, without departing from the scope and spirit of the invention as disclosed in the accompanying claims.

What is claimed is:

1. A method of controlling a washing machine, comprising:

a first step of detecting the amount of eccentricity of laundry in a drum to determine whether the laundry is a single load or a multiple load, after a washing operation is performed, and then water is drained out of the drum;

a second step of carrying out a spin-drying action based on the determined load amount and performing a rinsing operation;

a third step of changing the number of eccentricity detections based on the determination as to whether the initially determined load amount is the single load or the multiple load to redetermine the load amount, when the amount of eccentricity is redetected to carry out the spin-drying action; and a fourth step of carrying out a final spin-drying action according to a spin-drying operation after a final rinsing action is carried out.

2. The method as set forth in claim 1, wherein the first step comprises:

a first stage of detecting the amount of eccentricity of the laundry 15 times or more to determine whether the detected amount of eccentricity of the laundry is equal to or greater than a reference value of eccentricity; and a second stage of determining that the laundry is the single load when the counted number of the detected amount of eccentricity equal to or greater than the reference value of eccentricity is a predetermined value or more and determining that the laundry is the multiple load when the counted number of the detected amount of eccentricity equal to or greater than the reference value of eccentricity is less than the predetermined value.

3. The method as set forth in claim 2, wherein it is determined at the second stage that the laundry is the single load when the counted number of the detected amount of eccentricity equal to or greater than the reference value of eccentricity is 14 or more.

4. The method as set forth in claim 1, wherein the second step comprises:

a third stage of carrying out the spin-drying action based on the determined load amount and carrying out a water supplying action, a rinsing action, and a water draining action; and a fourth stage of counting the number of rinsing actions whenever the rinsing actions are carried out to determine whether a final rinsing action is completed.

5. The method as set forth in claim 1, wherein the third step comprises:

a fifth stage of repeatedly detecting the amount of eccentricity several times, when the initially determined load amount is the single load, to compare the detected amount of eccentricity with the reference value of eccentricity; and a sixth stage of determining that the laundry is the single load when the counted number of the detected amount of eccentricity equal to or greater than the reference value of eccentricity is a predetermined value or more and determining that the laundry is the multiple load when the counted number of the detected amount of eccentricity equal to or greater than the reference value of eccentricity is less than the predetermined value such that the second step is performed based on the determined load amount.

6. The method as set forth in claim 5, wherein the amount of eccentricity is detected several times at the sixth stage, and it is determined that the laundry is the single load when the counted number of the detected amount of eccentricity equal to or greater than the reference value of eccentricity is 5 or more.

7. The method as set forth in claim 5, wherein, when the initially determined load amount is the multiple load, the load amount is redetermined at the third step based on the initial load amount determination of the second stage.

8. A method of controlling a washing machine, comprising:

a first step of rotating a drum for a predetermined period of time, after water is drained out of the drum, to detect the amount of laundry received in the drum;

a second step of, when the laundry amount is small as the result of the detection, detecting a value of eccentricity of the laundry in the drum to determine whether the laundry is a single load or a multiple load; and a third step of redetecting the value of eccentricity based on the determination as to whether the laundry is the single load or the multiple load to compare the redetected value of eccentricity with a reference value of eccentricity for the single load or the multiple load such that a spin-drying action is carried out based on the result of the comparison.

9. The method as set forth in claim 8, wherein the second step comprises:

a first stage of determining that the laundry is the multiple load without performing additional determination as to whether the laundry is the single load or the multiple load when the detected laundry amount is large and detecting the value of eccentricity to determine whether the detected value of eccentricity is equal to or greater than the reference value of eccentricity when the detected laundry amount is small.

10. The method as set forth in claim 9, wherein the value of eccentricity is detected a predetermined number of times or more at the first stage when the detected laundry amount is small, and it is determined that the laundry is the single load when the counted number of the detected value of eccentricity equal to or greater than the reference value of eccentricity is a predetermined value or more.

11. The method as set forth in claim 8, wherein the third step comprises:

a third stage of repeatedly performing the eccentricity detection until the detected value of the eccentricity is equal to or less than the reference value of eccentricity differently set according to the load amount; and a fourth stage of, when the detected value of the eccentricity is equal to or less than the reference value of eccentricity, rotating the drum at predetermined revolutions per minute such that the spin-drying action is carried out.

12. A method of controlling a washing machine, comprising:

a first step of detecting load amount of laundry received in a drum, after water is drained out of the drum, to determine whether the load amount is a single load or a multiple load;

a second step of detecting the amount of eccentricity of the laundry in the drum, when it is determined that the load amount is the single load, to compare the detected amount of the eccentricity with a reference value of eccentricity;

a third step of performing the next operation or determining whether the detected value of eccentricity is a value of eccentricity within a resonance band based on the result of the comparison; and a fourth step of, when the detected value of eccentricity is the value of eccentricity within the resonance band, rotating the drum at revolutions per minute set within the resonance band for a predetermined period of time such that a temporary spin-drying action is carried out to dry the laundry.

13. The method as set forth in claim 12, wherein a rinsing or final spin-drying action of the next operation is carried out at the third step when the detected value of eccentricity is less than the reference value of eccentricity, and it is determined at the third step whether the detected value of eccentricity is the value of eccentricity within the resonance band when the detected value of eccentricity is equal to or greater than the reference value of eccentricity.

14. The method as set forth in claim 12, wherein the value of eccentricity within the resonance band is set to prevent collision of the drum with an outer case of the washing machine due to vibration or noise generated when the spin-drying action is carried out by the eccentricity of the laundry.

15. The method as set forth in claim 12, wherein the fourth step comprises:

a first stage of rotating the drum at revolutions per minute set according to the resonance band for the predetermined period of time such that the temporary spin-drying action is carried out to dry the laundry when the detected value of eccentricity is the value of eccentricity within the resonance band as the result of the determination of the third step, and repeating the second step when the detected value of eccentricity is not the value of eccentricity within the resonance band; and a second stage of temporarily stopping the operation of the washing machine and repeating the second step.

16. The method as set forth in claim 15, wherein, when the detected value of eccentricity is the value of eccentricity within the resonance band, the drum is rotated at 100 to 230 rpm at the first stage such that the temporary spin-drying action is carried out to dry the laundry.

* * * * *